United States Patent [19]

Eaton et al.

[11] Patent Number: 4,839,815

[45] Date of Patent: Jun. 13, 1989

[54] YARN PACKAGE OFFTAKE PERFORMANCE MONITORING

[75] Inventors: David C. Eaton, Buxton; Christopher J. Lawrence, Macclesfield, both of England

[73] Assignee: Rieter Scragg Limited, Macclesfield, England

[21] Appl. No.: 80,664

[22] Filed: Aug. 3, 1987

Related U.S. Application Data

[63] Continuation-in-part of Ser. No. 806,814, Dec. 10, 1985, abandoned.

[30] Foreign Application Priority Data

Jan. 19, 1985 [GB] United Kingdom ..... 8501403

[51] Int. Cl.[4] ..... B65H 63/00; G06F 15/46

[52] U.S. Cl. ..... 364/470; 73/160; 57/265; 242/36

[58] Field of Search ..... 364/470, 551, 508; 73/159, 160; 57/264, 265; 242/36, 45; 226/24, 45; 28/194

[56] References Cited

U.S. PATENT DOCUMENTS

| | | | |
|---|---|---|---|
| 4,045,659 | 8/1977 | Akagawa et al. | 364/470 |
| 4,051,722 | 10/1977 | Feeler | 364/470 |
| 4,173,787 | 11/1979 | Katona et al. | 73/160 |
| 4,330,094 | 5/1982 | Mayer | 242/36 |
| 4,548,085 | 10/1985 | Grundy | 73/862.48 |
| 4,566,319 | 1/1986 | Yamazaki et al. | 73/160 |

*Primary Examiner*—John R. Lastova

*Attorney, Agent, or Firm*—Oblon, Fisher, Spivak, McClelland & Maier

[57] ABSTRACT

The invention provides a method of monitoring yarn package offtake performance comprising withdrawing yarn from a package, for a predetermined period of time continuously measuring the tension of said yarn at predetermined time intervals throughout said withdrawal and updating the obtained tension distribution data with each tension measurement. The method also includes noting the maximum and minimum tensions measured and the limiting values of a range of tensions outside which range only a predetermined proportion of said measured tensions fall, and determining an offtake performance factor from said maximum, minimum and limiting values of tensions.

20 Claims, 4 Drawing Sheets

TESTING
Results for total UNWIND period of :- 0 hours 1.0000 minutes 1000. metres of yarn UNWOUND at 1000 m/min No. of yarn breaks = 1

AVERAGE = 3 gram
TMAX. = 10 gram
Pf1 = 2.00
SPREAD = 3 gram

CARPET level = 5 gram
TMIN. = 0 gram
Pf2 = 3.33
Pf3 = 6.7

PEAKING FACTOR = 20.0

Subsection time period = 0.033333 minutes
Total no. of subsections requested = 30
Unwinding speed = 1000 m/min
Length of yarn unwound per subsection = 33. m

YARN PACKAGE OFFTAKE PERFORMANCE MONITORING

This application is a continuation-in-part application of Ser. No. 806,814, filed Dec. 10, 1985, now abandoned.

This invention relates to yarn package offtake performance monitoring and apparatus used for such monitoring.

BACKGROUND OF THE INVENTION

In order to further process any packaged yarn it is necessary to withdraw such yarn from the package onto which it has been wound at the conclusion of a previous process. It is essential for satisfactory subsequent processing that the yarn can be withdrawn from the package in an even manner, without undue tension fluctuations or yarn breakages. In consequence it is important that the package be wound in such a manner that the offtake performance of the package meets with certain requirements. It follows therefore that it is desirable to know the offtake performance of a package wound under certain winding conditions, so that such winding conditions may be adjusted if necessary to ensure that packages wound under determinable conditions have the requisite offtake performance.

DESCRIPTION OF THE PRIOR ART

It has long been the custom to run packages, wound under differing winding conditions, to a knitter, loom or other yarn processing machine so as to observe the offtake performance and to note the quality and regularity of the knitted or woven fabric or otherwise processed yarn. In such a method offtake tension variations over relatively short lengths of yarn may be monitored and yarn breaks during unwinding noted. For this purpose a tension recording device giving a trace output has been used. However it is impractical to record the offtake tension continuously by this means during the unwinding of a complete package since the length of the trace thus produced would be excessive. In addition, the trace requires interpretation, which is a subjective operation and hence does not lead to an objective assessment of the offtake performance of the package. Furthermore such equipment has a relatively poor response and does not sense all of the tension variations, leading to an incorrect performance assessment.

As an alternative to the above, it is known to record tension levels at discrete intervals of, for example, between 5 secs and 0.2 secs. However at current commercial yarn unwinding speeds of up to 1350 m/min some 3 to 4 metres of yarn will pass between tension recordings even at the higher recording frequency, thereby allowing some tension variations to pass unrecorded. The readings obtained by this method have been used to determine the number of tension peaks which are a predetermined percentage higher than the average tension determined over a certain control length monitored at the start of the test. Although this method does give an indication of the offtake performance of a package it has been found not to be entirely satisfactory and it does not take account of the gradual increase in tension towards the centre of the package.

It is an object of the present invention to provide a method of and apparatus for monitoring the offtake performance of a yarn package which is simple and effective and avoids or minimises the aforementioned disadvantages.

SUMMARY OF THE INVENTION

The invention provides a method of monitoring yarn package offtake performance comprising withdrawing yarn from a package, for a predetermined period of time continuously measuring the tension for said yarn at predetermined time intervals throughout said withdrawal and updating the obtained tension distribution data with each tension measurement. The method may also include noting the maximum and minimum tensions measured and the limiting values of a range of tensions outside which range only a predetermined proportion of said measured tensions fall, and determining an offtake performance factor from said maximum, minimum and limiting values of tension.

Said limiting values may comprise high and low values above which and below which respectively 2% of said measured tensions fall.

The method may also comprise withdrawing a succession of predetermined lengths of yarn from a package, and for each of said lengths determining a respective offtake performance factor as aforesaid, and determining an overall offtake performance factor for said succession of lengths.

The tension of said yarn may be measured at time intervals of less than 0.01 seconds, preferably of less than 0.002 seconds, and even intervals of 0.001 seconds.

Said predetermined length or succession of predetermined lengths may be the total of yarn wound on said package, or may be a part thereof.

Said offtake performance factor may be determined in accordance with the formula $$\text{Factor} = T^2\text{Max}\ (T_H = T_L)/Tav \times T_H$$

where

TMax is the maximum tension measured

Tav is the average of the measured tension values and $T_H$ and $T_L$ are high and low limiting tension values respectively above which and below which only a predetermined proportion of said measured tensions fall.

The invention may also comprise apparatus for performing the aforementioned method of the invention, comprising a tension monitor operable to sense continuously the tension in a yarn being withdrawn from a package at predetermined time intervals throughout said withdrawal, and to provide an output signal of respective magnitude in response to each value of tension sensed, programmable means operable receive said output signals and to calculate the tension distribution after each tension measurement. The programmable means may also be operable to note the maximum and minimum values of said sensed tensions, and the limiting values of a range of tensions outside which range only a predetermined proportion of said sensed tensions fall, and to calculate an offtake performance factor from said maximum, minimum and limiting values of tension.

Said tension monitor may comprise a plate having a yarn contacting part extending therefrom and displaced from a mounting part of said plate, mounting means for said plate to which said mounting part of said plate is rigidly secured, and sensing means operable to sense deflection of said yarn contacting part relative to said mounting part under tension in said yarn and to provide said output signal in response to said deflection. Said yarn contacting part may be of cylindrical form, and guide means may be provided to guide said yarn around said yarn contacting part to make a predetermined angle of wrap therearound. Said angle of wrap may be substantially 120°. Said plate may be dimensioned to provide a preferred axis of deflection and said sensing means may be responsive to displacement of said plate at a location spaced from and to the opposite side of said axis of deflection from said yarn contacting part.

Said apparatus may include output means operable to display and/or print said offtake performance factor or factors and/or the proportion of tension values falling within each of a plurality of ranges of tension values.

BRIEF DESCRIPTION OF THE DRAWINGS

The invention will now be further described with reference to the accompanying drawings in which.

DETAILED DESCRIPTION OF THE PREFERRED EMBODIMENTS

Figure 1:
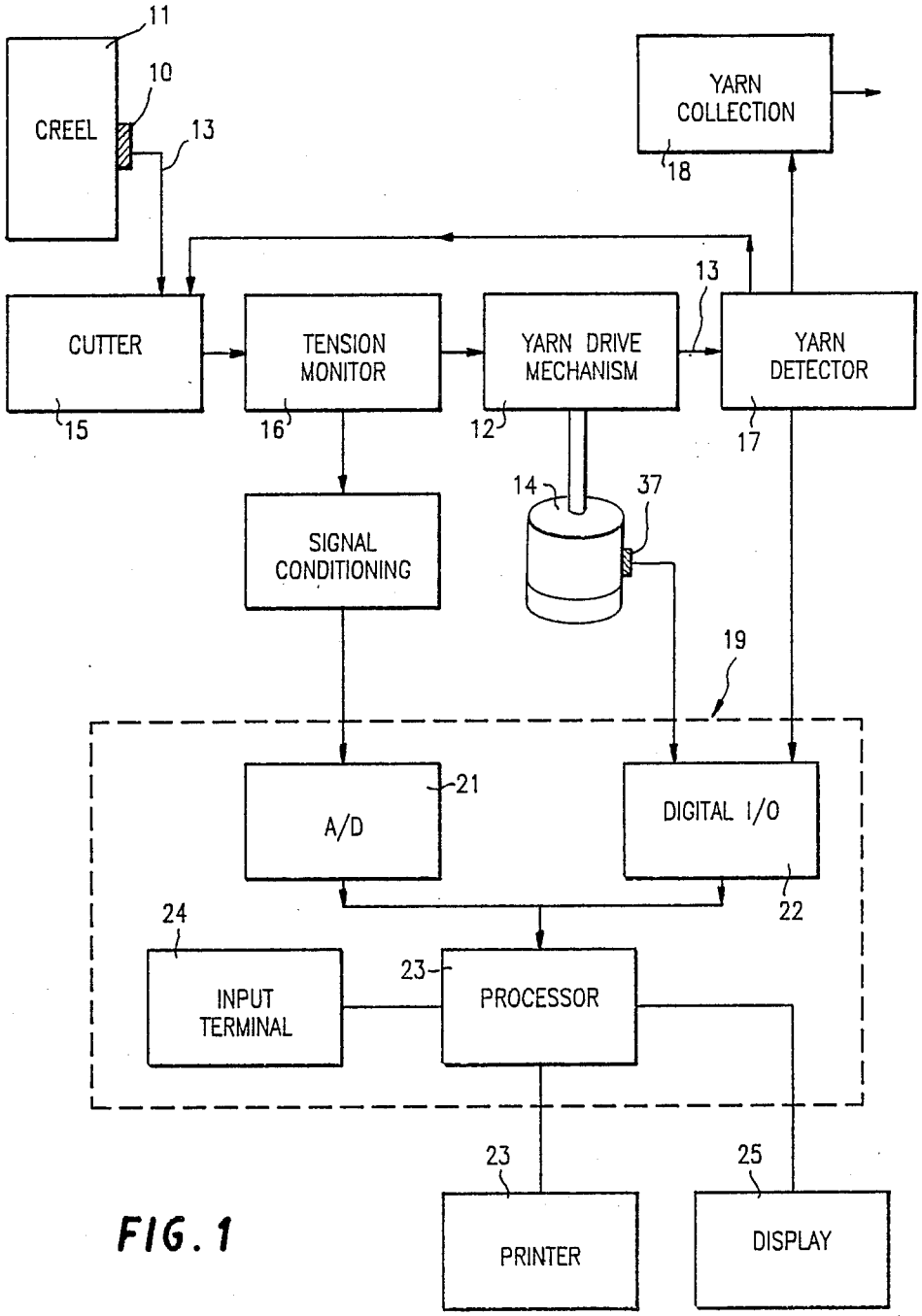
FIG. 1 is a schematic layout of the apparatus

Referring now to FIG. 1 there is shown apparatus for monitoring the offtake performance of a package 10 mounted in a creel 11. The apparatus comprises a yarn drive mechanism 12, preferably in the form of a pair of rollers forming a nip through which the yarn 13 passes, one of the rollers being driven by a motor 14 so as to withdraw the yarn 13 from the package 10. The yarn 13 passes through a cutter 15, a tension monitor 16, the drive mechanism 12, a yarn detector 17 and to a yarn collector or wind-up means 18. The yarn detector 17 is coupled electrically with the yarn cutter 15 to cause the yarn 13 issuing from the package 10 to be cut in the event of the yarn 13 failing to reach the yarn collector 18. The yarn detector 17 and a commercially available speed sensing device (37) of the motor 14 are coupled electrically to the programmable means 19 to record each yarn break and the motor speed. Also coupled to the programmable means 19 is the tension monitor 16, via a signal conditioning device 20 which amplifies and filters the analog electrical signals emanating device 20 is fed to an analog/digital converter 21 of programmable means 19 whilst the digital outputs from motor 14 and yarn detector 17 are fed to a digital input/output device 22. The outputs from the converter 21 and digital I/O 22 are fed to a processor 23 to which an input terminal 24 is coupled. The output from the processor 23 is fed to either or both of a visual display unit 25 and a printer 26.

Figure 2:
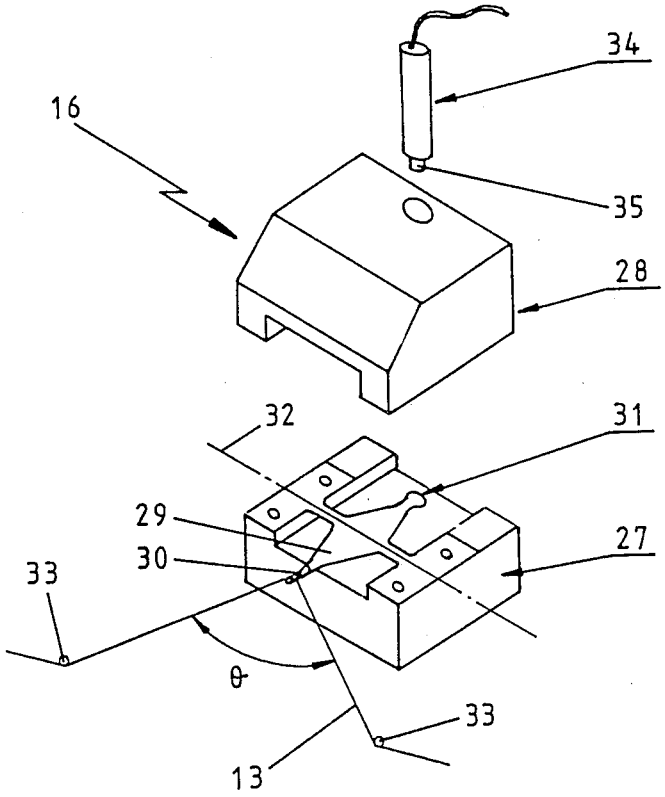
FIG. 2 is an exploded perspective view of the tension monitor of the apparatus of FIG. 1, and FIGS. 3 and 4 are a typical printed output from a test of a package.

Referring now to FIG. 2, the tension monitor 16 comprises a base 27 and an upper body 28 which in use are attached to each other by screws (not shown). Mounted in the base 27 is a torsion plate or blade 29 having a cylindrical yarn contacting part 30 at one end thereof, a sensor target part 31 at the opposite end thereof and being shaped with a mounting part 36 to provide a preferred axis of deflection 32 midway between the yarn contacting and sensor target parts 30, 31. Yarn guides 33 are positioned so that the yarn 13 makes an angle of wrap $\theta$ round the cylindrical yarn contacting part 30 of 120°, thereby providing that the downwards load on the yarn contacting part 30 is equal to the tension in the running yarn 13. Other angles of wrap may be chosen if desired with an appropriate factoring of the sensor output. The sensor 34 comprises a non-contact displacement probe which is mounted in the upper body 28 so that its probe and 35 is aligned with and adjacent the sensor target part 31 of the blade 29. In use the tension in the running yarn 13 causes a downwards force on the yarn contacting part 30 of blade 29, which twists about axis 32 causing an upwards deflection of sensor target part 31 of blade 29. The deflection of sensor target part 31 is proportional to the yarn tension and its displacement relative to the probe end 35 produces an electrical output which is linear with tension over the range of tensions occurring in practice.

As previously mentioned the output from the sensor 34 is amplified and filtered by signal conditioning device 20 and then fed to the programmable means 19. The operation of the apparatus is as follows.

The programmable means 19 is programmed and the input data relating to a particular test is fed into the programmable means using the input terminal 24. Such input data relates to the time for which a length of yarn is to be unwound and monitored, the number of sub-sections within the chosen time period (preferably fixed), the spaced of the motor 14 and test identifying data. The test is then run and the resultings therefrom evaluated. The data for each test-run is analysed in sixty equal sub-sections. Therefore the number of tension samples taken during each sub-section, is equal to the total number of samples taken during the entire run divided by sixty.

The programmed means (20) uses each sampled tension signal value to update a running statistical distribution of all previously sampled tension values for a particular sub-section. At the end of a test run sixty of these statistical distributions have been compiled and can be used individually to indicate how the offtake tension has varied during the period of the test run or, they can be combined to give an overall assessment of package offtake. By these means the collected yarn offtake tension data, which may amount to tens of millions of individual values, is statistically reduced to form sixty probability density distribution which define the probability of finding the offtake tension at any given value during the period of the test run.

For an ergodic process the probability density distribution may be defined as:

$$P(x) = \lim_{(T \to \infty)} \left[ \frac{t1}{T} \right]$$

where: p1 t1 = time during which the signal lies between an arbitrary amplitude range x & X+dx T = total time This function is implemented by the programmed means in the following manner:

The sampled tension signal data, taken at regular time intervals, is summed up into a memory location dependent upon the value of the sample (n) and the current sub-section number (k).

The Probability Density Function (PDF) is derived digitally using the following algorithm:

$$PDF = \frac{L}{N}(n,k) \times 100$$

-continued $$\left\{\begin{matrix} n = 1 & \text{to } 100 \\ k = 1 & \text{to } 60 \end{matrix}\right\}$$

where:

$=L(n,k)=$summed value in memory location n,k

N=total no. of samples taken

Figure 3:
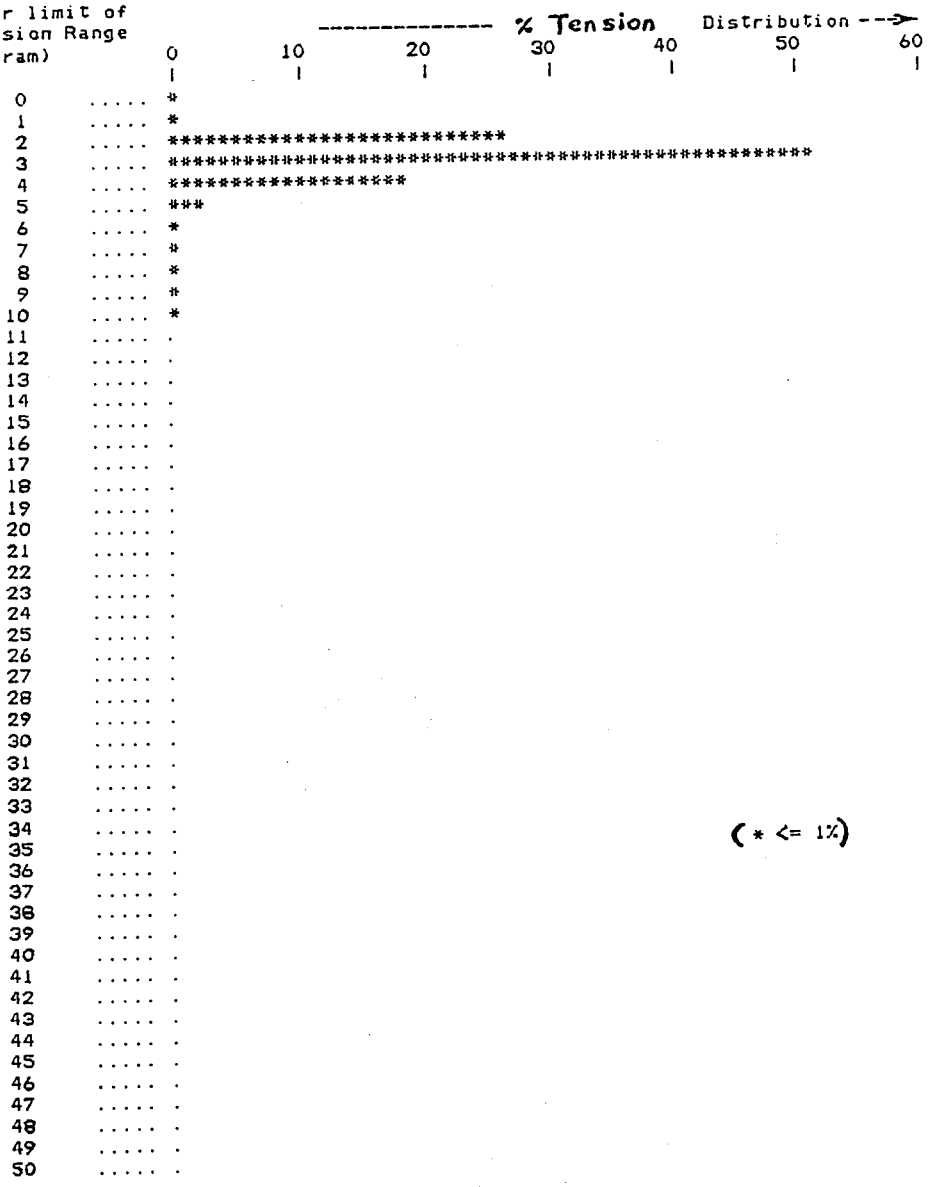
Figure 4:
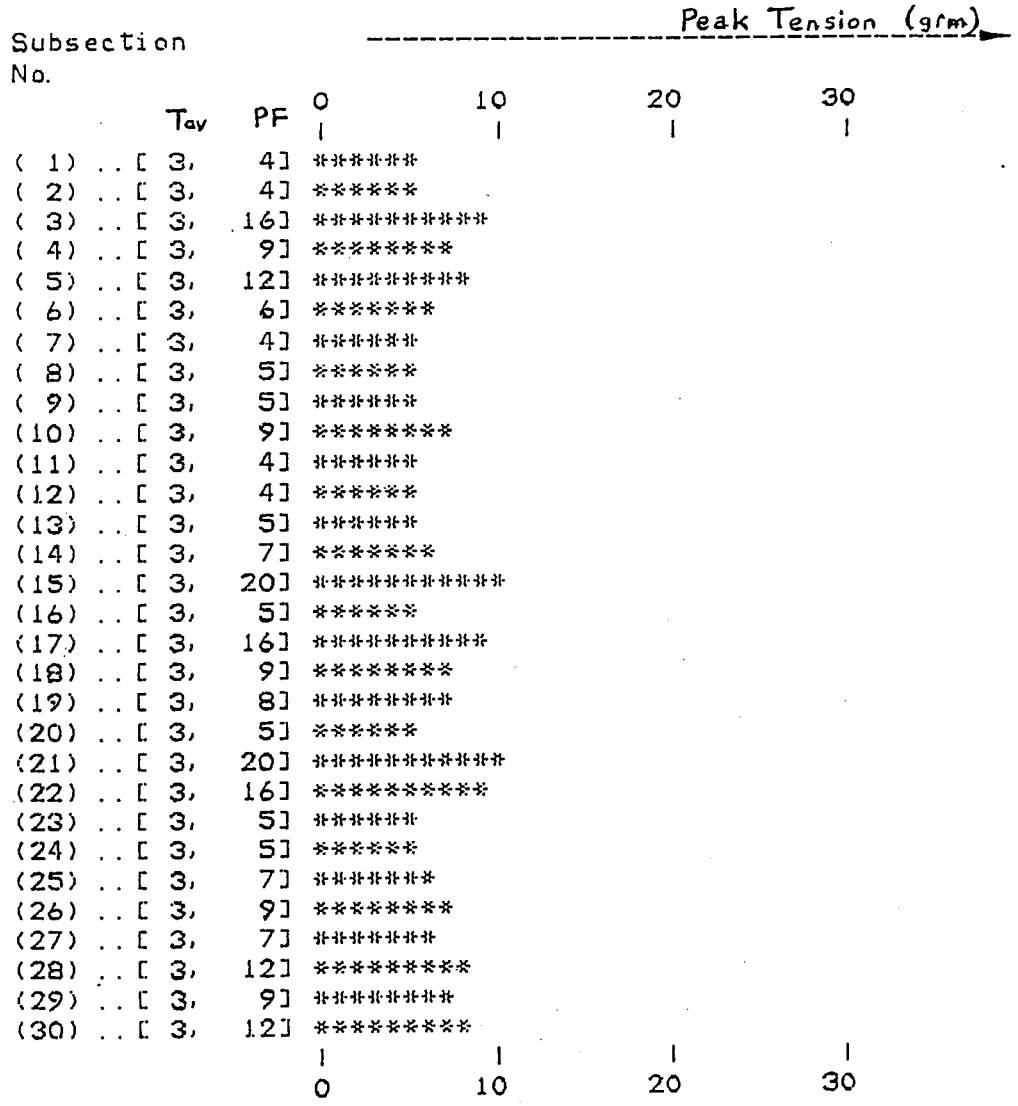

Maximum and minimum tensions are established during data collection by comparison with previously noted sub-section and overall values. When data collection finishes cumulative distributions are derived from the probability distribution functions for each sub-section and the statistical parameters used to calculate the PPF are taken directly from these cumulative distributions (eg: mean tension =L50). The motor speed information is used to determine if the required length of yarn has been analysed. The yarn detection is provided so that sampling can be halted by the computer if the yarn should break during analysis. FIGS. 3 and 4 show typical printed outputs from the printer 26. FIG. 3 shows a histogram of the percentage of the tension readings taken in a test which fall within each of 50 tension ranges of 1 gram increments. It will be seen that some 51% of readings lay in the 2 to 3 gram range, whilst TMax lies in the 9 to 10 gram range and TMin the 0 to 1 gram range. The output from the processor 23 shows that in fact Taverage is 3 gram, TMax is 10 gram and TMin is 0 gram. The processor 23 has also calculated the values of $T_H$ and $T_L$, $T_H-T_L$ and the peaking factor for the test. In this case $T_H$ is the tension value below which 98% of the tension readings fall and $T_L$ is the tension value below which only 2% of the tension readings fall, the former being 5 gram and referred to as the carpet level, and $T_H-T_L$ being 3 gram and referred to as the spread. The peaking factor, which is given by the formula $T^2Max(spread)/Tav\times T_H$ is calculated to be 20 for this test. The lower the value of the peaking factor the better the offtake performance of the package since it represents lesser tension fluctuations throughout the unwinding process. Zero tension fluctuations would result in a peaking factor of zero whilst peaking factor values of greater than 100 represent unacceptable offtake performance for most applications.

FIG. 4 shows a breakdown of the test into sub-tests, ie test results for each of 30 sub-sections within the length of yarn tested in producing the results shown in FIG. 3. For each sub-section Tav and the peaking factor are shown, together with a histogram of peak tension in each sub-section. This output enables an assessment of the variation of output performance as the package unwinding progresses to be made, and areas of potential difficulty ie high tension variation and possible yarn breakage to be determined, such areas usually being associated with patterning.

By this means not only can the overall offtake performance of the package be assessed, but the variation of that performance throughout the unwinding process can be evaluated in a simple and reliable manner. In addition a printout similar to that of FIG. 3 for each sub-section may be obtained for a more detailed study of the package offtake performance to be made if desired.

We claim:

1. A method of monitoring yarn package offtake performance comprising the steps of:

withdrawing yarn under tension from a package;

measuring the tension of said yarn at predetermined time intervals for a predetermined period of time, to obtain tension measurements;

including maximum and minimum tension measurements, during said step of withdrawing, to obtain a tension distribution; and successively updating said obtained tension distribution with each tension measurement obtained.

2. A method according to claim 1 further comprising the steps of:

determining said maximum and minimum tension measurements and tension measurements which define limiting values of a range of tensions outside which range only a predetermined proportion of said tension measurements fall.

3. A method according to claim 2 further comprising the step of:

determining an offtake performance factor from said maximum, minimum and limiting values of tension measurements.

4. A method accordingly to claim 3 wherein said offtake performance factor is calculated in accordance with, $Factor=T^2Max\ (T_H-T_L)\ /\ Tav\times T_H$, where TMax is the maximum tension measurement, Tav is the average of the tension measurements, and $T_H$ and $T_L$ are high and low limiting tension measurements, respectively above which and below which only a predetermined proportion of said tension measurements fall.

5. A method according to claim 3 comprising:

monitoring the yarn package offtake performance for a plurality of successive periods of time during said step of withdrawing, determining an offtake performance factor for each period and determining an overall offtake performance factor for said plurality of periods.

6. Apparatus for monitoring yarn package offtake performance comprising:

a tension sensing means for sensing the tension in a yarn being withdrawn from a package at predetermined time intervals for a predetermined period of time and for providing output signals of tension measurement proportional to each tension sensed, and programmable means which receives said output signals from said tension sensing means and calculates a tension distribution after each sensing of tension.

7. Apparatus according to claim 6 wherein said tension sensing means provides measurements including maximum and minimum tension measurements; and said programmable means further comprises means for determining said maximum and minimum tension measurements and tension measurements which define limiting values of a range of tensions outside which range only a predetermined proportion of said tension measurements fall.

8. Apparatus according to claim 7 wherein said programmable means further comprises:

means for calculating an offtake performance factor from said maximum, minimum and limiting values of tension measurement.

9. Apparatus according to claim 8 wherein said programmable means further comprises:

means for calculating said offtake performance factor in accordance with, $Factor=T^2Max\ (T_H-T_L)\ /Tav\times T_H$ where TMax is the maximum tension measurement Tav is the average of the tension measurements and $T_H$ and $T_L$ are high and low limiting tension measurements respectively above which and below which only a predetermined proportion of said tension measurements fall.

10. Apparatus according to claim 5 wherein said tension monitor comprises:

a plate having a mounting part and a yarn contacting part which is displaced from said mounting part, mounting means for said plate, means rigidly securing said mounting part to said mounting means, and sensing means operable to sense deflection of said yarn contacting part relative to said mounting part under said yarn tension and to provide said output signal in response to said deflection.

11. Apparatus according to claim 10 wherein said yarn contacting part is of cylindrical form, and comprises:

guide means disposed to guide said yarn around said yarn contacting part to make a predetermined angle of wrap around said yarn contacting part.

12. Apparatus according to claim 10 where said plate is dimensioned to provide an axis of deflection having opposed sides, said yarn contacting part is disposed to one side of said axis of deflection, said mounting part lies on said axis of deflection, and said sensing means is disposed to sense deflection of said plate at a location spaced from and to the opposite side of said axis of deflection from said yarn contacting part.

13. Apparatus according to claim 6 comprising:

a yarn drive mechanism, a cutter, said tension monitor, a yarn detector coupled electrically to said cutter, output means and yarn collection means.

14. Apparatus according to claim 13 wherein said yarn drive mechanism comprises:

a pair of rollers providing a nip through which said yarn passes, at least one of said rollers being driven in rotation.

15. Apparatus according to claim 14 wherein the yarn driving mechanism comprises:

a speed sensing device, and said yarn detector and said speed sensing device are coupled electrically to the programmable means.

16. Apparatus according to claim 15 comprising:

a digital input/output device of said programmable means to which signals from said yarn detector and said speed sensing device are fed.

17. Apparatus according to claim 16 comprising:

a signal conditioning device operable to amplify and filter said output signals of said tension monitor and feed said amplifier and filtered signals to said programmable means.

18. Apparatus according to claim 17 comprising:

an analog/digital convertor of said programmable means for receiving said amplified and filtered signals from said signal conditioning device.

19. Apparatus according to claim 18 comprising:

a processor of said programmable means operable to receive outputs from said convertor and said input/output device.

20. Apparatus according to claim 19 where an output from said processor is fed to said output device.

* * * * *

UNITED STATES PATENT AND TRADEMARK OFFICE

CERTIFICATE OF CORRECTION

PATENT NO. : 4,839,815

DATED : June 13, 1989

INVENTOR(S) : David C. Eaton and Christopher J. Lawrence

It is certified that error appears in the above-identified patent and that said Letters Patent is hereby corrected as shown below:

In the drawings, figure 2 should be deleted to appear as per attached figure 2.

Column 2, line 36, please change "$(T_H = T_L)$" to --$(T_H - T_L)$--.

Column 3, line 46, between "emanating" and "device" insert --from the tension monitor 16. The output from the signal conditioning--.

Column 4, line 26, change "spaced" to --speed--.

Column 4, line 27, change "resultings" to --results--.

Column 7, line 5, change "5" to --6--.

Column 8, line 21, change "amplifier" to --amplified--.

Signed and Sealed this

Fourth Day of September, 1990

*Attest:*

HARRY F. MANBECK, JR.

*Attesting Officer*

*Commissioner of Patents and Trademarks*

UNITED STATES PATENT AND TRADEMARK OFFICE

CERTIFICATE OF CORRECTION

PATENT NO. : 4,839,815

DATED : June 13, 1989

INVENTOR(S) : David C. Eaton and Christopher J. Lawrence

It is certified that error appears in the above-identified patent and that said Letters Patent is hereby corrected as shown below:

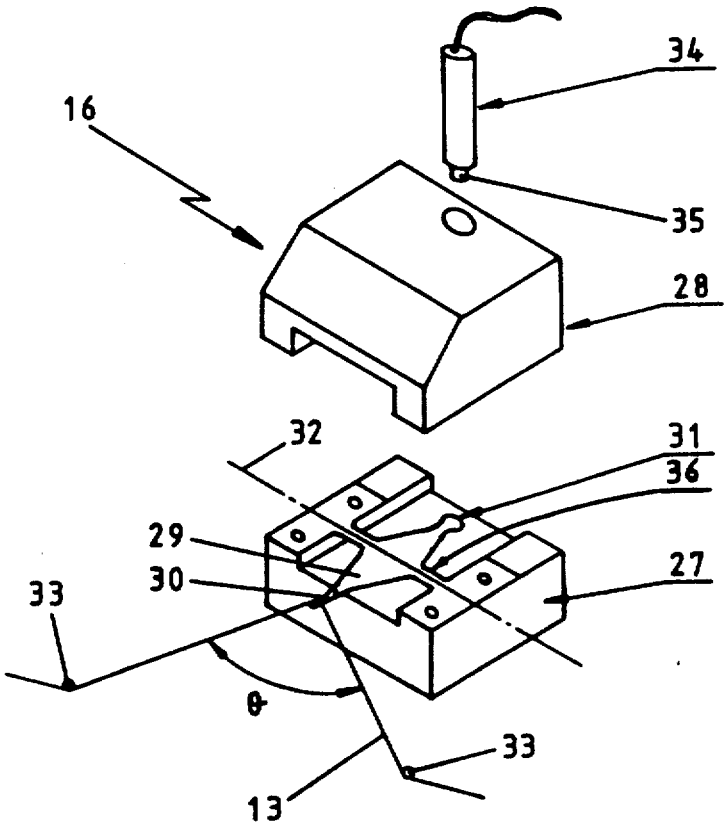

Fig 2